US007188691B2

(12) United States Patent
Yong et al.

(10) Patent No.: US 7,188,691 B2
(45) Date of Patent: Mar. 13, 2007

(54) METAL SEAL WITH IMPACT-ABSORBING RING

(75) Inventors: Zhou Yong, Spring, TX (US); Jiaqing Yu, Houston, TX (US)

(73) Assignee: Smith International, Inc., Houston, TX (US)

( * ) Notice: Subject to any disclaimer, the term of this patent is extended or adjusted under 35 U.S.C. 154(b) by 325 days.

(21) Appl. No.: 10/868,511

(22) Filed: Jun. 15, 2004

(65) Prior Publication Data

US 2005/0274549 A1 Dec. 15, 2005

(51) Int. Cl.
*E21B 10/25* (2006.01)

(52) U.S. Cl. ..... 175/371; 277/352; 384/94

(58) Field of Classification Search ..... 175/371; 384/94; 277/352, 380
See application file for complete search history.

(56) References Cited

U.S. PATENT DOCUMENTS

| | | | | | |
|---|---|---|---|---|---|
| 3,061,319 | A | * | 10/1962 | Snyder | 277/380 |
| 3,761,145 | A | | 9/1973 | Schumacher, Jr. | 308/8.2 |
| 3,804,425 | A | * | 4/1974 | Goodfellow et al. | 277/381 |
| 3,990,525 | A | | 11/1976 | Penny | 175/337 |
| 4,014,595 | A | | 3/1977 | Dolezal | 308/8.2 |
| 4,102,419 | A | | 7/1978 | Klima | 175/371 |
| 4,172,502 | A | | 10/1979 | van Nederveen | 175/369 |
| 4,176,848 | A | | 12/1979 | Lafuze | 277/92 |
| 4,179,003 | A | | 12/1979 | Cooper et al. | 175/371 |
| 4,199,156 | A | | 4/1980 | Oldham et al. | 277/92 |
| 4,235,480 | A | | 11/1980 | Olschewski et al. | 308/8.2 |
| 4,248,484 | A | | 2/1981 | Newcomb | 308/8.2 |
| 4,249,622 | A | | 2/1981 | Dysart | 175/277 |
| 4,252,330 | A | | 2/1981 | Crow | 277/92 |
| 4,256,351 | A | | 3/1981 | Langford, Jr. | 308/8.2 |
| 4,306,727 | A | | 12/1981 | Deane et al. | 277/12 |
| 4,344,629 | A | * | 8/1982 | Oelke | 277/306 |
| 4,359,111 | A | | 11/1982 | Gonzalez | 175/227 |
| 4,367,904 | A | | 1/1983 | Olschewski et al. | 384/95 |
| 4,372,624 | A | | 2/1983 | Neilson | 384/94 |
| 4,394,020 | A | | 7/1983 | Oelke | 277/1 |
| 4,428,588 | A | | 1/1984 | Oelke | 277/83 |
| 4,429,854 | A | | 2/1984 | Kar et al. | 384/94 |
| 4,466,621 | A | | 8/1984 | Garner et al. | 277/84 |
| 4,466,622 | A | | 8/1984 | Deane et al. | 277/92 |

(Continued)

FOREIGN PATENT DOCUMENTS

| | | |
|---|---|---|
| GB | 2331773 | 6/1999 |

(Continued)

OTHER PUBLICATIONS

Hooper et al., *The Design of a Mechanical Face Seal for a Roller Cone Drill Bit*, The American Society of Mechanical Engineers, Dec. 1991 (11 p.).

(Continued)

*Primary Examiner*—Hoang Dang
(74) *Attorney, Agent, or Firm*—Conley Rose, P.C.

(57) ABSTRACT

Disclosed is a seal assembly for dynamically sealing between rotatable members, such as employed to seal the rolling cone of a rock bit. One preferred assembly includes an energizer, first and second seal rings, and a cushioning ring having an L-shaped cross-section disposed about portions of one of the seal rings to seal and absorb impact loads and thereby protect the more-rigid seal rings.

44 Claims, 4 Drawing Sheets

U.S. PATENT DOCUMENTS

| | | | | |
|---|---|---|---|---|
| 4,516,641 | A | 5/1985 | Burr | 175/228 |
| 4,537,409 | A | 8/1985 | Estes et al. | 277/83 |
| 4,548,283 | A | 10/1985 | Young | 175/107 |
| 4,552,233 | A | 11/1985 | Klima | 175/371 |
| 4,613,005 | A | 9/1986 | Olsson | 175/371 |
| 4,619,534 | A | 10/1986 | Daly et al. | 384/94 |
| 4,623,028 | A | 11/1986 | Murdoch et al. | 175/371 |
| 4,629,338 | A | 12/1986 | Ippolito | 384/94 |
| 4,666,001 | A | 5/1987 | Burr | 175/371 |
| 4,671,368 | A | 6/1987 | Burr | 175/371 |
| 4,722,404 | A | 2/1988 | Evans | 175/371 |
| 4,747,604 | A | 5/1988 | Nakamura | 277/83 |
| 4,753,303 | A | 6/1988 | Burr | 175/367 |
| 4,753,304 | A | 6/1988 | Kelly, Jr. | 175/371 |
| 4,762,189 | A | 8/1988 | Tatum | 175/371 |
| 4,813,502 | A | 3/1989 | Dysart | 175/337 |
| 4,822,057 | A | 4/1989 | Chia et al. | 277/84 |
| 4,838,365 | A | 6/1989 | Kotch | 175/371 |
| 4,903,786 | A | 2/1990 | Welsh | 175/367 |
| 4,923,020 | A | 5/1990 | Kelly, Jr. et al. | 175/372 |
| 5,005,989 | A | 4/1991 | Karlsson | 384/94 |
| 5,009,519 | A | 4/1991 | Tatum | 384/94 |
| 5,027,911 | A | 7/1991 | Dysart | 175/57 |
| 5,040,624 | A | 8/1991 | Schumacher et al. | 175/371 |
| 5,080,183 | A | 1/1992 | Schumacher et al. | 175/371 |
| 5,199,514 | A | 4/1993 | Titus | 175/107 |
| 5,295,549 | A | 3/1994 | Dolezal et al. | 175/371 |
| 5,323,863 | A | 6/1994 | Denton | 175/57 |
| 5,332,235 | A * | 7/1994 | Fone et al. | 277/380 |
| 5,358,061 | A | 10/1994 | Van Nguyen | 175/371 |
| 5,360,076 | A | 11/1994 | Kelly, Jr. et al. | 175/371 |
| 5,362,073 | A | 11/1994 | Upton et al. | 277/92 |
| 5,402,858 | A | 4/1995 | Quantz et al. | 175/371 |
| 5,456,327 | A | 10/1995 | Denton et al. | 175/371 |
| 5,472,058 | A | 12/1995 | Hooper et al. | 175/371 |
| 5,513,711 | A | 5/1996 | Williams | 175/57 |
| 5,513,715 | A | 5/1996 | Dysart | 175/371 |
| 5,518,077 | A | 5/1996 | Blackman et al. | 175/353 |
| 5,524,718 | A | 6/1996 | Kirk et al. | 175/371 |
| 5,603,385 | A | 2/1997 | Colebrook | 175/45 |
| 5,842,700 | A | 12/1998 | Fang et al. | 277/336 |
| 5,842,701 | A | 12/1998 | Cawthorne et al. | 277/336 |
| 5,875,861 | A | 3/1999 | Daly et al. | 175/371 |
| 5,944,126 | A | 8/1999 | Brolund | 175/371 |
| RE36,452 | E | 12/1999 | Upton et al. | 277/336 |
| 6,026,917 | A | 2/2000 | Zahradnik et al. | 175/371 |
| 6,033,117 | A | 3/2000 | Cariveau et al. | 384/94 |
| 6,068,070 | A | 5/2000 | Scott | 175/428 |
| 6,109,376 | A | 8/2000 | Pearce | 175/371 |
| 6,123,337 | A | 9/2000 | Fang et al. | 277/336 |
| 6,142,249 | A | 11/2000 | Zahradnik et al. | 175/371 |
| 6,170,830 | B1 | 1/2001 | Cawthorne et al. | 277/336 |
| 6,176,330 | B1 | 1/2001 | Burr | 175/371 |
| 6,179,296 | B1 | 1/2001 | Cawthorne et al. | 277/336 |
| 6,196,339 | B1 | 3/2001 | Portwood et al. | 175/371 |
| 6,247,545 | B1 | 6/2001 | Burr et al. | 175/371 |
| 6,254,275 | B1 | 7/2001 | Slaughter, Jr. et al. | 384/92 |
| 6,264,367 | B1 | 7/2001 | Slaughter, Jr. et al. | 384/94 |
| 6,279,671 | B1 | 8/2001 | Panigrahi et al. | 175/371 |
| 6,305,483 | B1 | 10/2001 | Portwood | 175/371 |
| 6,336,512 | B1 | 1/2002 | Siracki et al. | 175/371 |
| 6,357,540 | B1 | 3/2002 | Page et al. | 175/371 |
| 6,406,030 | B1 | 6/2002 | Fang et al. | 277/407 |
| 6,427,790 | B1 | 8/2002 | Burr | 175/371 |
| 6,536,542 | B1 | 3/2003 | Fang et al. | 175/371 |
| 6,598,690 | B2 | 7/2003 | Peterson | 175/371 |
| 6,752,223 | B2 | 6/2004 | Panigrahi et al. | 175/57 |
| 6,769,500 | B2 | 8/2004 | Miglierini | 175/371 |
| 2002/0108788 | A1 | 8/2002 | Peterson et al. | |

FOREIGN PATENT DOCUMENTS

| | | |
|---|---|---|
| GB | 2404399 | 2/2005 |

OTHER PUBLICATIONS

Search Report for GB51194.6 dated Jul. 12, 2005 (1 p.).
US 5,887,981, 03/1999, Slaughter, Jr. et al. (withdrawn)

* cited by examiner

METAL SEAL WITH IMPACT-ABSORBING RING

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

1. Field of the Invention

The invention relates generally to seal assemblies for sealing between a rotating and a static member. In one aspect, and more particularly, the invention relates to seals for rolling cone bits used to drill a borehole for the ultimate recovery of oil, gas or minerals. Still more particularly, the invention relates to multi-part dynamic metal seals that are employed to seal and protect the bearing surfaces between the rolling cone cutters and the journal shafts on which they rotate.

2. Description of the Related Art

An earth-boring drill bit is typically mounted on the lower end of a drill string. With weight applied to the drill string, the drill string is rotated such that the bit engages the earthen formation and proceeds to form a borehole along a predetermined path toward a target zone.

A typical earth-boring bit includes one or more rotatable cone cutters. The cone cutters roll and slide upon the bottom of the borehole as the drillstring and bit are rotated, the cone cutters thereby engaging and disintegrating the formation material in their path. The rotatable cone cutters may be described as generally conical in shape and are therefore referred to as rolling cones.

Rolling cone bits typically include a bit body with a plurality of journal segment legs. The rolling cones are mounted on bearing pin shafts (also called journal shafts or pins) that extend downwardly and inwardly from the journal segment legs. As the bit is rotated, each cone cutter is caused to rotate on its respective journal shaft as the cone contacts the bottom of the borehole. The borehole is formed as the action of the cone cutters removes chips of formation material ("cuttings" or "drilled solids") which are carried upward and out of the borehole by the flow of drilling fluid which is pumped downwardly through the drill pipe and out of the bit. Liquid drilling fluid is normally used for oil and gas well drilling, whereas compressed air is generally used as the drilling fluid in mining operations.

Seals are provided in glands formed between the rolling cones and their journal shafts to prevent lubricant from escaping from around the bearing surfaces and to prevent the cutting-laden, abrasive drilling fluid from entering between the cone and the shaft and damaging the bearing surfaces. When cuttings and/or abrasives are conveyed into the seal gland, they tend to adhere to the gland and/or seal component surfaces, and may cause deformation, damage and/or slippage of the seal components. Moreover, the cuttings can accelerate abrasive wear of all seal components and of the bearing surfaces.

In oil and gas drilling, the cost of drilling a borehole is proportional to the length of time it takes to drill to the desired depth and location. The time required to drill the well, in turn, is greatly affected by the number of times the drill bit must be changed before reaching the targeted formation. This is the case because each time the drill bit wears out or fails as a borehole is being drilled, the entire string of drill pipes, which may be miles long, must be retrieved from the borehole, section by section in order to replace the bit. Once the drill string has been retrieved and the new bit installed, the bit must be lowered to the bottom of the borehole on the drill string, which again must be constructed section by section. The amount of time required to make a round trip for replacing a bit is essentially lost from drilling operations. As is thus obvious, this process, known as a "trip" of the drill string, requires considerable time, effort and expense. It is therefore advantageous to maximize the service life of a drill bit. Accordingly, it is always desirable to employ drill bits that will be durable enough to drill for a substantial period of time with acceptable rate of penetration (ROP).

The durability of a bit and the length of time that a drill bit may be employed before it must be changed depend upon numerous factors. Importantly, the seals must function for substantial periods under extremely harsh downhole conditions. The type and effectiveness of the seals greatly impact bit life and thus, are critical to the success of a particular bit design.

One cause of bit failure arises from the severe wear or damage that may occur to the bearings on which the cone cutters are mounted. These bearings can be friction bearings (also referred to as journal bearings) or roller type bearings, and are typically subjected to high drilling loads, high hydrostatic pressures, and high temperatures.

As previously mentioned, the bearing surfaces in typical bits are lubricated, and the lubricant is retained within the bit by the seals. The seal is typically in the form of a ring and includes a dynamic seal surface that is placed in rotating contact against a non-rotating seal surface, and a static seal surface that engages a surface that is stationary with respect to the seal ring. Although the bit will experience severe and changing loading, as well as a wide range of different temperature and pressure conditions, the dynamic and static seal surfaces must nevertheless remain sealingly engaged in order to prevent the lubricant from escaping and/or cuttings from entering the lubricated areas, and should perform these duties throughout the life of the bit's cutting structure.

A variety of seal types are known in the art. These include O-ring type seals made of rubber or other elastomeric material. The service life of bits equipped with such elastomeric seals is generally limited by the ability of the seal material to withstand the different temperature and pressure conditions at each dynamic and static seal surface.

Certain metal-to-metal seals have been employed in rolling cone bits. Such metal-to-metal seals were developed in order to increase the working life of the bearings, given that the failure of conventional elastomeric O-rings was one of the most frequent causes of bit failure. However, with metal-to-metal seals, great care and attention must be employed in their design, manufacture and assembly to ensure that, in use, the engaging sealing surfaces remain undamaged and in close contact with one another so as to ensure a good seal. In use, the bit will experience severe and varying loads, as well as a wide range of different temperatures and pressures. Under such a working environment, the cone cutters will tend to experience axial movement along the journal shaft, as well as radial movement, wobbling or rocking about the journal shaft. Such wobbling or rocking movement arises from the clearances inherent between the cone cutter and the journal shaft, and the extreme forces that are imparted to the cone cutter as it rotates about the borehole.

Excessive axial movement and/or wobbling of the cone cutter have the potential for damaging the seal components. More particularly, such components typically include relatively hard metal rings with very precisely machined and planar surfaces that must remain in good condition in order to seal effectively. However, the extreme and violent forces imparted to the cone cutter are, in turn, transmitted to these seal components. These forces may cause the seal elements to impact one another, thereby causing damage and lessening the life or effectiveness of the seal. The rocking or rolling motion of the cone cutter transmitted to the seal rings may likewise cause the sealing surfaces to become worn in a non-uniform way. Again, such damage or deformation is to be minimized. Where such seal components experience damage, the lubricant is able to escape, and cutting-laden drilling fluid is allowed to enter the seal gland causing still further deterioration and damage to the seal components. Eventually, enough cuttings may pass into the journal gap and enough lubricant may be lost such that rotation of the cone cutter is impeded and drilling dynamics are changed, eventually requiring the bit to be removed from the borehole. Accordingly, protecting the integrity of the seal is of utmost importance.

It is therefore desirable that a new, durable and long lasting seal assembly be devised, one having the benefits offered by metal-to-metal seals, including long life and relative insensitivity to high temperatures and pressures, but one that is not as susceptible to damage caused by impact loading transmitted from the cone cutter to the seal components.

Accordingly, to provide a drill bit with better performance and longer life, and thus to lower the drilling costs incurred in the recovery of oil and other valuable resources, it would be desirable to provide a seal that has the potential to provide longer life than conventional elastomeric seals and metal-to-metal seals. Preferably, such seals would provide a bit that will drill with acceptable ROP for longer periods so as to increase bit life and increase in footage drilled as compared to bits employing conventional seals.

SUMMARY OF EXEMPLARY PREFERRED EMBODIMENTS

Described herein is a drill bit and a seal assembly for dynamically sealing between rotatable members, such as between a rolling cone and a journal shaft of a rock bit.

In accordance with at least one embodiment of the invention, a metal-to-metal seal assembly includes a first seal ring having a dynamic sealing surface and a static sealing surface opposite from the dynamic sealing surface. The seal assembly also includes a second ring having a flange portion extending axially along the radially-outermost surface of the first ring and a base portion extending radially along the static sealing surface of the first ring. In this embodiment, the second ring includes a material that is softer than the material of the first ring. The seal assembly may include a third ring having a sealing surface biased by an energizer into engagement with the first sealing surface of the first seal ring. The second ring may be made of an elastomer or, alternatively, may be made of a relatively soft metal or plastic as compared to the hardness of the first seal ring. When positioned between a shaft and a rotatable member disposed on the shaft, such as a rolling cone cutter of a drill bit, the second ring may absorb impacts and prevent damage and/or misalignment from occurring to the other seal components. The use of relatively soft materials for the second ring may also permit the first seal ring and other seal components to be manufactured to less exacting dimensional and finish standards and tolerances.

In accordance with certain of the embodiments described herein, the second seal ring may be L-shaped and may engage either the stationary or the rotatable member. In the context of the drill bit, the L-shaped ring may engage either the rotatable cone cutter or the drill bit body.

In accordance with other embodiments of the invention, the seal assembly includes one or more annular voids between the seal assembly components. For example, a void may be provided between the first seal ring and the second ring, between the second ring and the cone cutter, as well as between the second ring and the third ring so as to permit the material of the second ring to deform as it absorbs impacts imparted to the bit.

In accordance with another embodiment of the invention, the outer diameter of the first seal ring is greater than the inside diameter of the second ring as defined by the inner surface of the axially-extending flange. Upon assembly, the flange portion of the second seal ring is thus squeezed between the first seal ring and the cone cutter, the reactive force, in turn, helping to retain the first seal ring in the cone cutter upon assembly, and helping to ensure that the first seal ring rotates with the cone cutter.

Embodiments described herein thus comprise a combination of features and advantages directed to overcome some of the deficiencies or shortcomings of prior art seal assemblies and drill bits. The various characteristics mentioned above, as well as other features and characteristics described in more detail below, will be readily apparent to those skilled in the art upon reading the following detailed description of preferred embodiments, and by referring to the accompanying drawings.

BRIEF DESCRIPTION OF THE DRAWINGS

For a more detailed description of the preferred embodiments of the present invention, reference will now be made to the accompanying drawings, wherein.

DETAILED DESCRIPTION OF EXEMPLARY PREFERRED EMBODIMENTS

Figure 1:
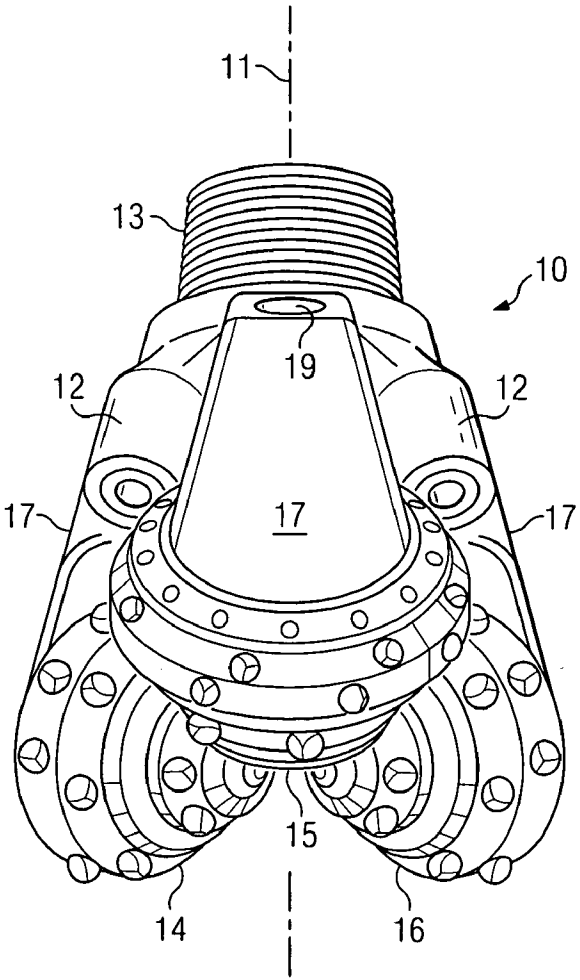
FIG. 1 is a perspective view of an earth boring bit.

Referring first to FIG. 1, an earth-boring bit 10 includes a central axis 11 and a bit body 12. Body 12 includes a threaded portion 13 on its upper end for securing the bit to the drillstring (not shown). Bit body 12 is composed of three sections or legs 17 that are joined together to form bit body 12. Rotatably connected to body 12 are three rolling cone cutters, 14, 15, 16. Each cone cutter 14–16 is rotatably mounted on a journal pin or shaft 18 (FIG. 2) that is oriented generally downward and inward toward the center of bit 10.

Each journal pin 18 and each cone cutter 14–16 is substantially the same, such that the description of one such journal pin 18 and one cone cutter 14 will adequately describe the others.

It is to be understood that seal assemblies are described herein with respect to a three cone bit for purposes of example only, and that the seal assemblies described herein may be employed in single cone bits, as well as in bits having two or more cones. Likewise, the seals described herein may have application beyond drill bits, and may be used wherever a shaft seal is required to seal between a rotatable member mounted on the shaft and a member that is stationary relative to the rotatable member.

Figure 2:
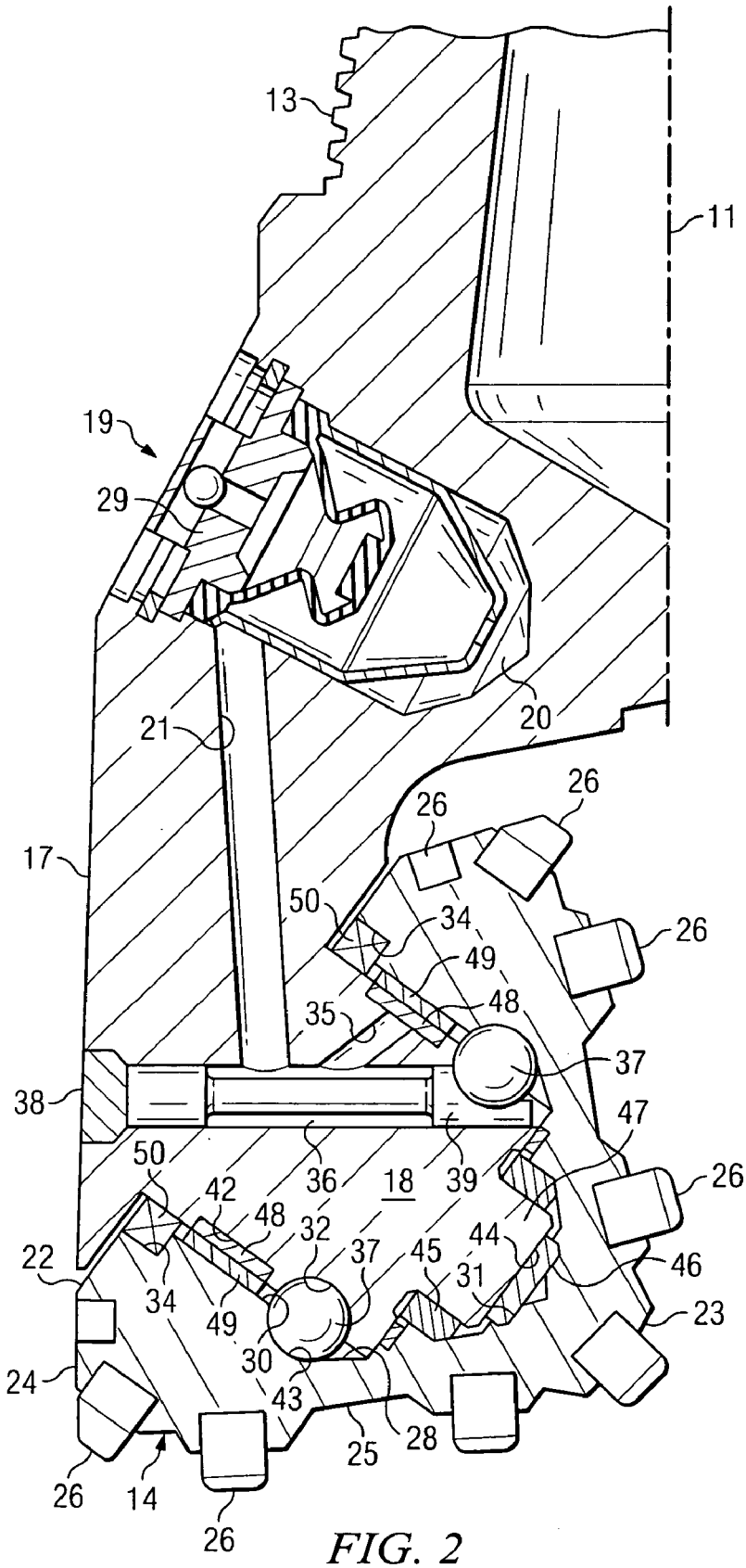
FIG. 2 is a partial section view taken through one leg and one rolling cone cutter of the bit shown in FIG. 1 and showing the seal assembly sealing between the rolling cone cutter and the leg of the bit body.

As best shown in FIG. 2, cone cutter 14 further includes a backface 22 and a nose portion 23 opposite backface 22. Cone 14 includes a frustoconical heel surface 24 and a generally conical surface 25 extending between heel surface 24 and nose 23. Secured within heel surface 24 and conical surface 25 are protruding cutter elements which, as depicted in FIGS. 1 and 2, comprise inserts 26, such as inserts made of tungsten carbide. Although not shown, the seals described herein may likewise be employed advantageously in "steel tooth" bits, also sometimes referred to as "milled tooth" bits, where the cutter elements are formed from the cone material, such as by a milling process, and coated with a hard-facing material.

Referring still to FIG. 2, cone cutter 14 includes a central cavity or bore 28, which receives the journal pin 18. Central bore 28 includes a bearing surface 30 and end surface 31. Formed in bearing surface 30 is a circumferential groove 43 for receiving a plurality of locking balls 37. Bearing surface 30 further includes a seal assembly recess 34 formed adjacent to back face 22.

Journal pin 18 includes a bearing surface 42 that is substantially concentric to bearing surface 30 in cone 14. Bearing surface 42 includes a groove 32 for receiving locking balls 37. A ball passageway 36 intersects groove 32 and forms a means by which locking balls 37 are placed into cone 14 during assembly. The locking balls retain cone 14 on the journal pin 18. After the balls 37 are in place, ball retainer 39 is inserted through ball passageway 36 and an end plug 38 is welded or otherwise secured to close off the ball passageway 36.

Journal pin 18 further includes a reduced diameter portion 47 and end-surface 44. Bearing surface 42 of pin 18 and bearing surface 30 of cone 14 may include cylindrical inlays 48, 49, respectively, that are disposed in grooves formed in the respective parts for reducing friction, such inlays being made, for example, of aluminum bronze alloys. A nose bushing 45 is disposed about reduced diameter portion 47 of pin 18. Cone 14 is disposed over the pin 18 with nose button 46 positioned between end-surface 44 and the end portion 31 of central bore 28.

Seal assembly 50, shown schematically in FIG. 2 and described in more detail below, is disposed about pin 18 so as to seal between cone cutter 14 and journal pin 18.

The bearing structure described and shown FIG. 2 is generally known as a journal bearing. Other types of bits, particularly in bits having larger diameters and bits designed for higher rotational speeds, may include roller bearings disposed between the journal pin and the cone steel. It is to be understood that the seal assemblies described herein can be used with all types of rotary cone bits, including journal bearing and roller bearing bits, and in both rock bits and mining bits.

The bearing surfaces 30, 42 between the cone 14 and the journal pin 18 are lubricated by grease. The grease is applied so as to fill the regions adjacent to the bearing surfaces and to fill various interconnected passageways such that, upon bit assembly, air is essentially excluded from the interior of the bit. The bit includes a grease reservoir 19, including a pressure compensation subassembly 29 and a lubricant cavity 20, which is connected to the ball passageway 36 by lubricant passageway 21. The grease is retained in the bearing structure and the various passageways, including diagonal passageway 35 and passageways 21, 36, by means of seal assembly 50. Likewise, seal assembly 50 prevents drilled cuttings and abrasive drilling fluid from passing seal assembly 50 and washing out the lubricant and damaging the bearing surfaces.

Figure 3:
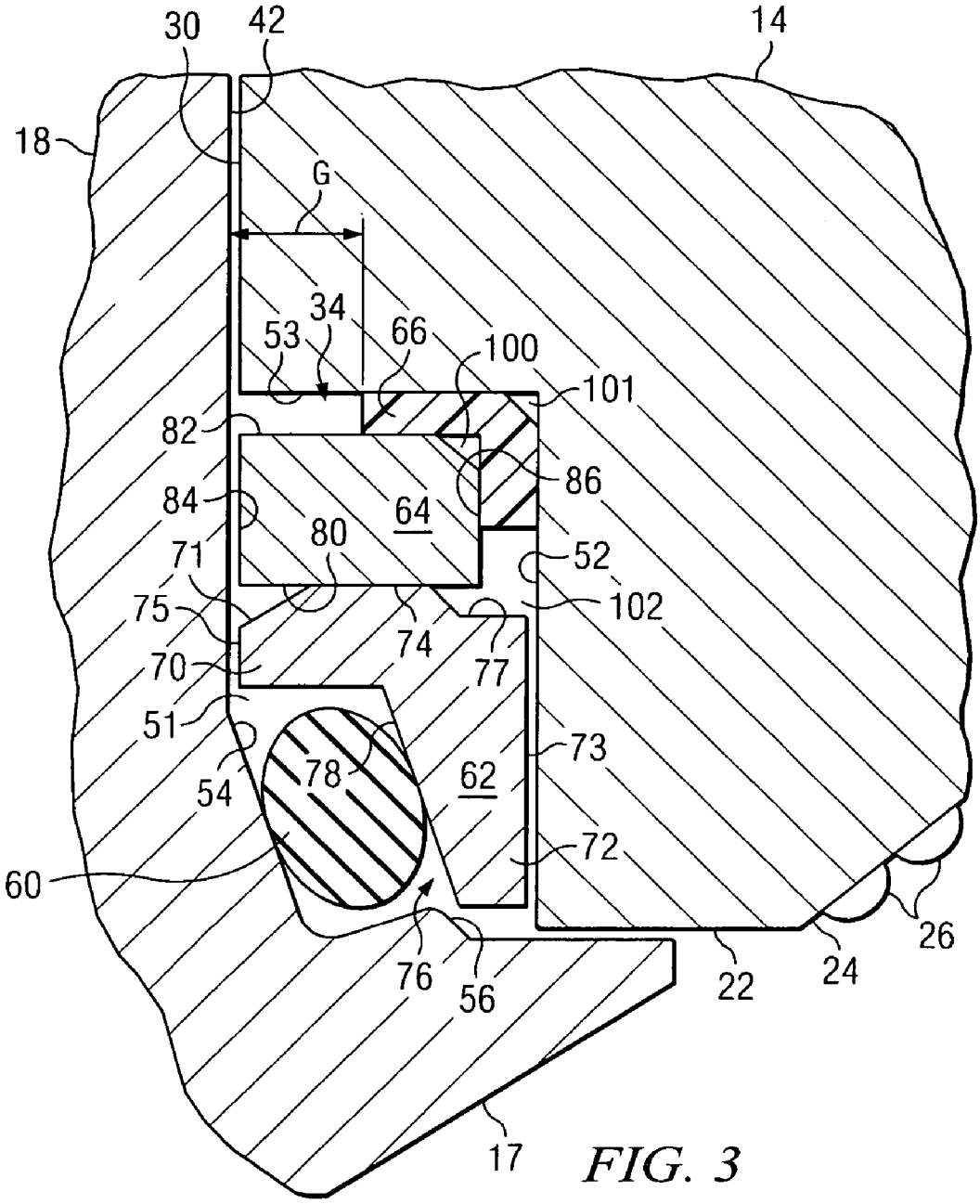
FIG. 3 is an enlarged cross-sectional view of the seal assembly shown in FIG. 2.
Figure 4:
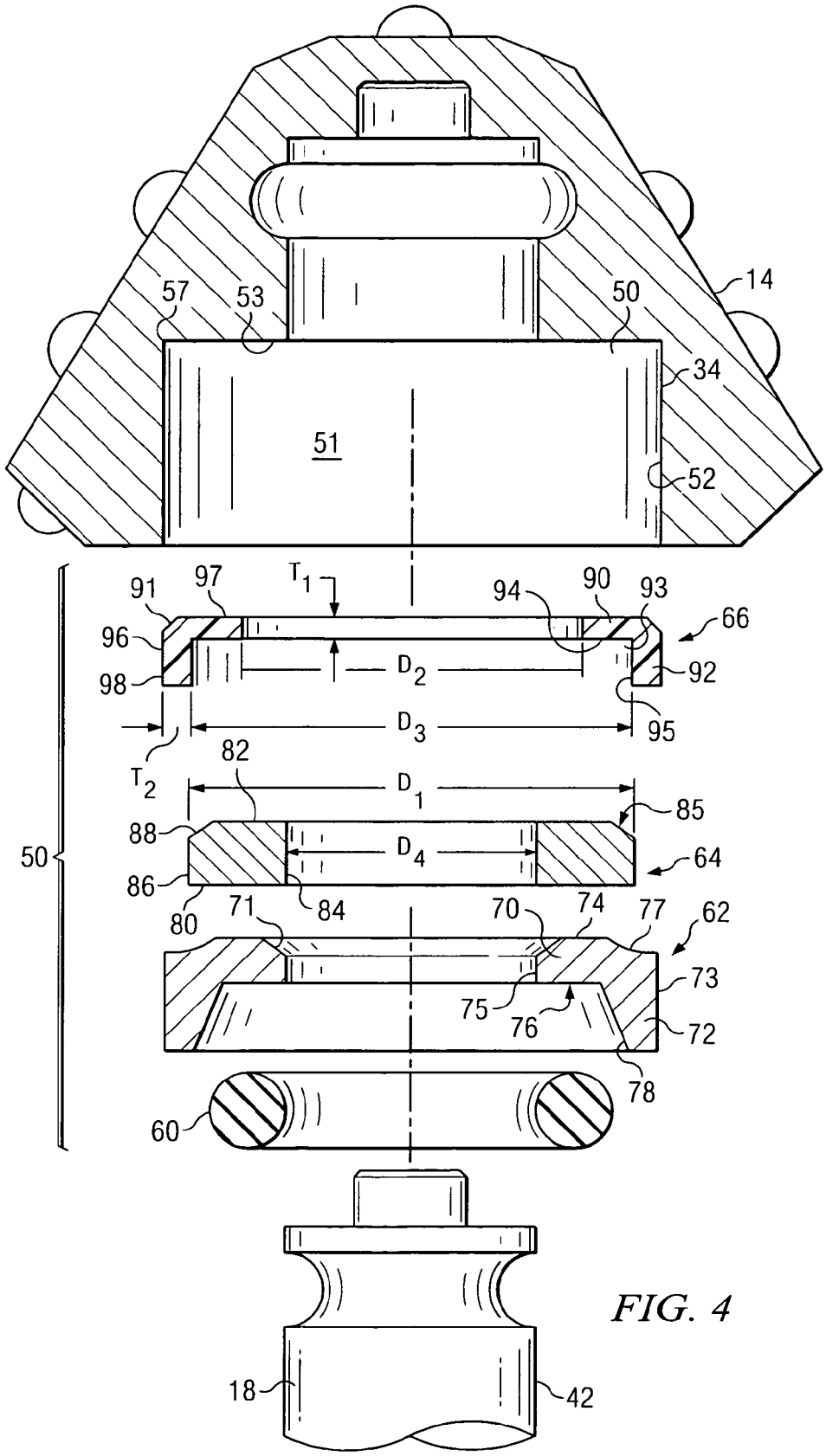
FIG. 4 is an exploded, cross-sectional view, of the seal assembly shown in FIG. 3.

Referring now to FIGS. 3 and 4, seal assembly 50 generally includes energizer 60, static metal seal ring 62, dynamic metal seal ring 64, and cushioning ring 66. For convenience, seal ring 62 is referred to as "static" because it is substantially static in relation to bit body 17 and is not intended to rotate about bearing pin 18. Similarly, seal ring 64 is referred to as "dynamic" in this exemplary embodiment as it is intended to rotate relative to static seal ring 62, along with cone 14 and cushioning ring 66. Seal assembly 50 is retained within a seal gland 51, generally comprising recess 34 in cone 14, recess 34 including shaft-facing cylindrical surface 52 and annular surface 53 which intersect to form annular corner 57. As best shown in FIG. 3, seal gland 51 further includes journal pin bearing surface 42 and annular transition surface 54 that extends between bearing surface 42 and bit leg 17. Transition surface 54 further includes an annular extension 56 provided so as to help retain energizer 60 in position.

Energizer 60 is preferably made of an elastomer. In this embodiment, energizer 60 is an O-ring. In its uncompressed and unstretched state prior to assembly, energizer 60 has a generally circular cross-section and an inside diameter permitting it to be disposed about journal pin 18. Energizer 60 may have other cross-sectional shapes, such as oval or rectangular, as examples. It is preferred that energizer 60 be made of a material having a durometer hardness within the range of 55 to 95 A.

Static seal ring 62 is generally L-shaped in cross-section, and includes a base portion 70 and an axially-extending flange portion 72. Base portion 70 includes generally planar, annular sealing surface 74 for engaging dynamic seal ring 64. There is a bevel surface 71 between sealing surface 74 and inner surface 75. The width of bevel surface 71 controls the contact of sealing surfaces 74 and 80. The inner surfaces of base portion 70 and axial flange 72 form an energizer-capturing surface 76, including angled surface 78 which is formed at an angle of approximately 5–45° in relation to journal surface 42. Static seal ring 62 further includes cone facing outer surface 73, pin-facing inner surface 75, and annular recess 77 formed at the intersection of sealing surface 74 and cone facing outer surface 73. Static seal ring 62 is made of a relatively hard and rigid material, such as tungsten carbide, tool steel, or hardened stainless steel. The ring 62 may be made entirely of the same material or, alternatively, the ring may be made of materials having differing hardnesses and durabilities.

Referring still to FIGS. 3 and 4, in this embodiment, dynamic seal ring 64 has a generally rectangular cross-section and a central aperture having diameter $D_4$ that is slightly larger than the diameter of journal pin 18. Ring 64 includes a generally planar annular dynamic sealing surface 80, and an axially-facing surface 82 opposite from dynamic sealing surface 80. Facing surface 82 engages and rotates with cushioning ring 66 and, therefore, may sometimes be referred to as static surface 82, it being "static" with respect to cushioning ring 66. Seal ring 64 further includes a shaft-facing inner surface 84 and a cone facing outer surface 86, each being generally cylindrical. Surface 86 forms the radially-outermost surface of ring 64 and defines outer diameter $D_1$ of ring 64. The intersection of outer surface 86 and static surface 82 forms an annular shoulder 85. In this embodiment, shoulder 85 includes a beveled surface 88. As an alternative to bevel 88, annular shoulder 85 may instead be formed to include an annular groove or similar relief, which, as described in more detail below, is employed to form an annular void between seal ring 64 and cushioning ring 66. Dynamic seal ring 64 is preferably made of a hard and rigid material, such as the material used to form static seal ring 62.

Cushioning ring 66 includes base portion 90 and axially-extending flange portion 92 such that, in cross-section, cushioning ring 66 presents a generally L-shaped configuration. Cushioning ring 66 and its cross-sectional shape may refer to as L-shaped without regard to the relative length of flange portion 92 and base portion 90. That is, a cushioning ring 66 may be referred to as L-shaped even if portions 90 and 92 have the same length. What is meant by L-shaped herein is that a first portion extends from a second portion at generally a right angle. Likewise, a cushioning ring 66 may be L-shaped without regard to whether the extending portions 90, 92 have the same or differing cross-sectional thicknesses. In this embodiment, base portion 90 has a cross-sectional thickness $T_1$ that is less than the cross-sectional thickness $T_2$ of axially-extending flange 92 (FIG. 4). As best shown in FIG. 3, flange portion 92 in this embodiment preferably extends along the more than 30% of the entire thickness of dynamic seal ring 64 (i.e., from axially-facing surface 82 to sealing surface 80) although the length of the flange portion may vary. The length of base portion 90 may likewise vary; however, it is preferred that base portion 90 does not extend to bearing surface 42. Instead, it is preferred that the inside diameter $D_2$ (FIG. 4) of cushioning ring 66 be substantially greater than the outside diameter of journal pin 18 so as to leave a radially-extending gap "G" therebetween. As shown in FIG. 3, it is preferred that base portion 90 of cushion ring 66 extend radially inward to the inner diameter of sealing ring 64, but that gap G of at least 10% of distance $(D_1-D_4)/2$ remains. In this manner, the radially-innermost portion of axially-facing surface 82 of ring 64 remains uncovered and is not fully contacted by base portion 90 of cushioning ring 66.

Referring still to FIGS. 3 and 4, cushioning ring 66 includes an inner sealing surface 93, which, in turn, includes axially-facing surface 94 and radially-facing surface 95. Cylindrical surface 95 defines an inner diameter $D_3$ as measured in an uncompressed, unstretched state prior to assembly. For purposes described below, cushioning ring 66 is sized such that $D_3$ is less than diameter $D_1$ of seal ring 64.

Cushioning ring 66 further includes outer sealing surface 96 having axially-facing surface 97 and radially-facing outer surface 98. A beveled surface 91 extends between surfaces 98 and 97. Cushioning ring 66 is preferably made of an elastomeric material, such as HSN. It is preferred that the material of ring 66 range from 60 to 10 A, while the material used for energizer 60 ranges from 55 to 95 A. As an example, cushioning ring 66 may be made of an elastomer having a durometer hardness of 80 A, and the material of energizer 60 may have a hardness of 85 A.

Upon assembly of bit 10, energizer 60 is disposed about journal pin 18 and positioned at transition surface 54. Static seal ring 62 is likewise disposed about journal pin 18 and pressed against energizer 60 such that energizer 60 is received and retained within capturing surface 76.

Cushioning ring 66 has an outer diameter approximately equal to the diameter of seal gland 51 and defined by cylindrical surface 52, and ring 66 is disposed in gland 51 with axially-facing surface 97 engaging surface 53 of gland 51.

As previously described, the outside diameter $D_1$ of dynamic seal ring 64 is greater than the inside diameter $D_3$ of cushioning ring 66 as measured at radially-facing surface 95. Preferably, the difference $(D_1-D_3)/2$ between $D_1$ and $D_3$ ranges from 0.001 inch to 0.025 inch in this embodiment The specific value of the interference difference depends on $D_1$ or $D_3$ and the thickness of cushioning ring 66. In this manner, upon assembly of bit 10, dynamic seal ring 64 is disposed within the recess of cushioning ring 66 as formed by base portion 90 and flange portion 92. Because of its larger diameter, ring 64 squeezes the axially-extending flange 92 of cushioning ring 66. The reactive forces in ring 66 hold dynamic seal ring 64 in position as the cone cutter 14 is disposed about journal shaft 18. When cone 14, with cushioning ring 66 and dynamic seal ring 64 thus retained therein, is pressed on journal shaft 18, dynamic seal ring 64 engages static seal ring 62 which, in turn, squeezes energizer 60.

Referring to FIG. 3, upon assembly of cone cutter 14 on journal pin 18, energizer 60 is deformed and, in this way, energizes the seal assembly, meaning that it tends to bias static seal ring 62 firmly toward dynamic seal ring 64 so that good sealing contact is made between sealing surfaces 74 and 80. As previously described in this embodiment, the cushioning ring 66 preferably includes elastomeric qualities such that base portion 90 provides auxiliary or additional energization tending to bias dynamic seal ring 64 into sealing engagement with static seal ring 62.

Referring to FIG. 3, as assembled, the seal assembly of the above-described embodiment includes annular voids 100–102. Voids 100–102, as well as gap "G", are provided to permit the deformation of cushioning ring 66. That is, and as described in more detail below, as bit 10 and cone cutter 14 experience high pressures and impact loading in operation, cushioning ring 66 may deform and portions thereof extrude into one or more of annular voids 100–102 and gap "G."

The L-shaped configuration of cushioning ring 66 provides additional manufacturing and operational benefits. Because cushioning ring 66 extends along the radially-outermost surface 86 and axial facing surface 82 of dynamic seal ring 64, and because of the elastomeric nature of ring 66, the precise tolerances to which those surfaces of ring 64 would otherwise have to be manufactured can be relaxed, given that the elastomeric nature of ring 66 can account for a wider range of tolerances. Accordingly, manufacturing efficiencies may be provided. For example, the outer diameter of dynamic seal ring 64 need not be as precisely controlled when used in cooperation with cushioning ring 66. Likewise, the use of cushioning ring 66 may permit greater surface irregularities to exist of axial facing surface 82 of dynamic seal ring 64 than might otherwise be permissible.

Additionally, the relatively high coefficient of friction existing between cone 14 and cushioning ring 66, and between cushioning ring 66 and dynamic seal ring 64, helps to keep seal ring 64 stationary with respect to cone 14 as is required for there being a good dynamic seal between rings 64 and 62.

Further still, cushioning ring 66 provides rings 62, 64 with protection from impacts as might otherwise be imparted to the rings. More particularly, the bit is assembled and placed in operation, the cone cutters and seal assemblies undergo substantial changes in dynamic and kinematic conditions. For example, the bit components must absorb substantial impact loads and compressive forces as weight is placed on bit, and the bit is rotated in the borehole. During operation, the contact areas and loads between the energizers and the seal rings of the seal assembly 50 will change. Likewise, relative geometric positions between the seal components, and the pressures exerted between them, can change suddenly and dramatically. However, providing cushioning ring 66 between the cone cutter 14 and dynamic seal ring 64 reduces the likelihood that damage will occur to the sealing surfaces 74, 80 of rings 62, 64 respectively, because the relatively softer material of cushioning ring 66 can absorb the impact and deform to maintain dynamic sealing contact between sealing surfaces 74, 80. Impact in both axial and radial directions (relative to journal pin 18) are experienced by the bit during operation, and such loads are absorbed first by cushioning ring 66 before being transmitted to the harder and more rigid seal rings 62,64. In this manner, the components of seal assembly 50 may be described as self-adapting to maintain dynamic sealing between surfaces 74, 80, even when conditions change. Likewise, cushioning ring 66 is able to absorb impacts and lessen the likelihood of impacts to the cone cutter damaging seal rings 62, 64 as such loads are transmitted. Because of the relatively soft properties of cushioning ring 66, potentially damaging loads may be absorbed by ring 66 so that the position of ring 62 is not dramatically and detrimentally changed, and so that rings 62, 64 do not impact one another violently.

In this manner, cushioning ring 66 in this embodiment serves as an absorber of impacts from multiple directions, serves as an auxiliary energizer to maintain good sealing contact between the seal ring 62, 64, helps ensure that dynamic seal ring 64 rotates along with cone 14 and thus moves relative to seal ring 62, in addition to providing manufacturing and assembly efficiencies.

Figure 5:
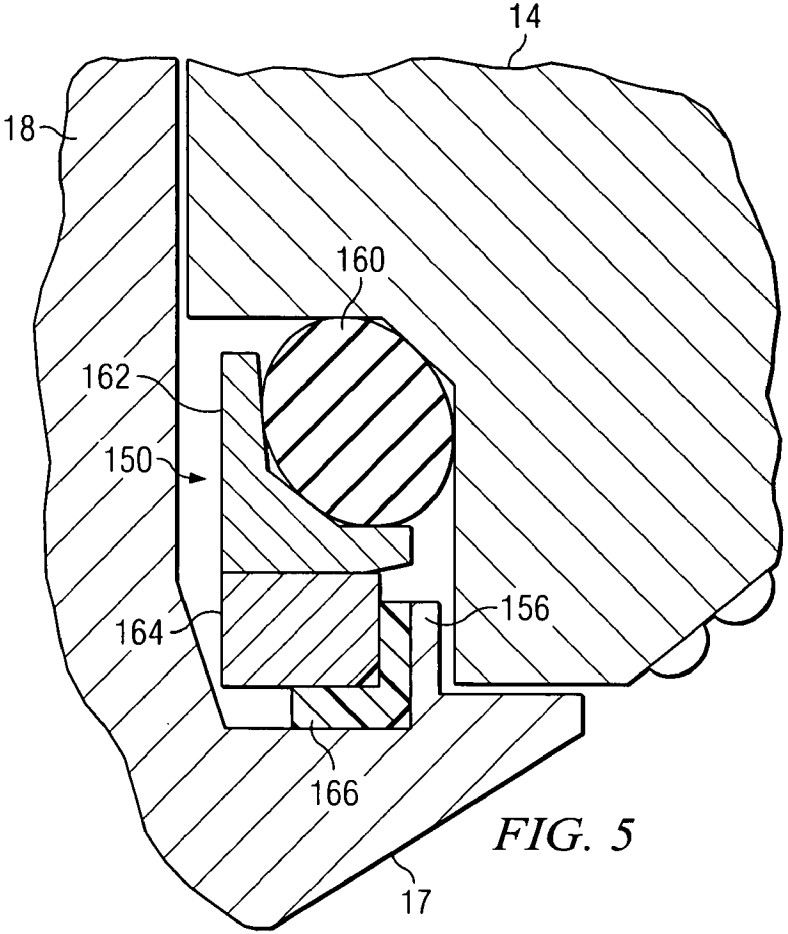
FIG. 5 is an enlarged cross-sectional view of an alternative seal assembly for sealing between the rolling cone cutter and bit body shown in FIG. 2.

Referring now to FIG. 5, an alternative seal assembly 150 is disclosed. In this embodiment, seal assembly 150 includes energizer 160 and cushioning ring 166, that are substantially identical to energizer 60 and cushioning ring 66 previously described. Seal assembly 150 also includes a static seal ring 164 and a dynamic seal ring 162 that are substantially the same as seal rings 62, 64 previously described. In seal assembly 150, energizer 160 engages cone 14 rather than shaft 18 as in the embodiment described with reference to FIGS. 3 and 4. Likewise, cushioning ring 166 in the embodiment shown in FIG. 5 engages bit leg 17 rather than cone 14. In the embodiment of FIG. 5, bit leg 17 includes a more pronounced and angular annular extension 156 as compared to the embodiment shown in FIG. 3.

Energizer 160 energizes the assembly 150 such that rings 162 and 164 remain in sealing contact. Cushioning ring 166 likewise provides an additional measure of axial energization, and additionally provides impact cushioning, as described above, to better enable seal rings 162, 164 to remain undamaged and in sealing contact. As in the embodiment previously described, cushioning ring 166 likewise provides manufacturing advantages in that the surfaces of seal ring 164 that engage cushioning ring 166 need not be machined to the exacting tolerances that might otherwise be required if ring 164 directly engaged bit body 17.

As previously described with reference to FIGS. 3–5, it is preferred that cushioning rings 66 and 166 be made of an elastomeric material. However, certain of the advantages provided by the previously described preferred embodiments may be obtained where these cushioning rings are made of a relatively soft metal, as compared to the hardness of rings 62, 64 and 162, 164. For example, and referring again to FIG. 3, cushioning ring 66 may be made of a relatively soft metal such as tin, lead, copper, aluminum, magnesium and their alloys. Although the hardness of these materials differ and, at least to some extent, overlap (depending upon the particular alloy chosen), these materials have a hardness less than 100 HB and, more particularly, fall within the general range of about 3–80 HB (as determined by the Brinell Test governed by ASTM E10-98 (metals)). As a more specific example, referring to FIG. 3, cushioning ring 66 may be made of a tin alloy having a hardness of approximately 8 HB while seal rings 62, 64 are made of tungsten carbide having hardness of approximately 733 HB. In this embodiment, cushioning ring 66 could provide the assembling and manufacturing advantages previously described given that the tin alloy is relatively soft, deformable, and will permit ring 64 to be manufactured to less stringent tolerances. Likewise, cushioning ring 66 made of tin or other such soft metal can provide impact resistance by absorbing impact loads and by deforming in response to such loads, so as to prevent such impact loading from being transmitted unabated to seal rings 62,64 where damage can occur. As used herein, the term "metallic" means made from a metal or a metal alloy.

There are a number of different tests by which the hardness of a material can be determined. The most recognized tests include the Rockwell Hardness Test, The Brinell Hardness Test, and the Vickers Hardness Test. The Rockwell Test is governed by ASTM E 18-98 (metals), C748-98 (graphites), D785-98 (plastics) and has units of HRA-HRV. The Brinell Test is governed by ASTM E10-98 (metals) and has units of HB or BHN. The Vickers Test is governed by ASTM E92-82 (1997)el (metals), C1327-99 (ceramics) and has units of HV.

Each of the hardness tests can measure the hardness of nearly any material (i.e. polymer, metal, ceramic), where each material is assigned a specific harness number (e.g. 479 HB or 513 HV or 50 HRC for Austenitic Stainless Steel).

By way of contrast with respect to the relatively soft metals described above, a conventional steel used in present day metal seal rings, such as 1018 steel, has a hardness of about 252 HB. Tungsten carbide generally is even harder. One typical tungsten carbide formulation has a hardness of approximately 612 HB. Various steels and steel alloys can be heat treated, such as through carbonization and tempering, to achieve hardnesses of certain tungsten carbide formulations.

The relatively soft cushioning ring 66, 166 may be made of materials other than metallic materials and still provide the desired impact absorption and manufacturing efficiencies. For example, seal ring 66, 166 may likewise comprise the following non-metallic materials:

Nylon-Zytel (Rockwell hardness of approximately R119);

Acetal (Rockwell harness of approximately R119-122); and

Polypropylene (Rockwell hardness of approximately R80-90).

Like the relatively soft metals identified above, these materials will deform somewhat upon assembly, and can therefore accommodate for relaxed manufacturing tolerances. Likewise, these materials can provide impact absorption and thereby help protect the harder seal rings from being damaged in use.

While various preferred embodiments of the invention have been showed and described, modifications thereof can be made by one skilled in the art. The embodiments herein are exemplary only, and are not limiting. Many variations and modifications of the apparatus and methods disclosed herein are possible and within the scope of the invention. Accordingly, the scope of protection is not limited by the description set out above, but is only limited by the claims which follow, that scope including all equivalents of the subject matter of the claims.

What is claimed is:

1. A drill bit for drilling through earthen formations comprising:

a bit body;

a journal shaft extending from said bit body;

an energizing ring disposed about said journal shaft;

a first seal ring disposed about said journal shaft and contacting said energizing ring, said first seal ring having a first annular seal surface;

a second seal ring disposed about said journal shaft and having a second annular sealing surface engaging said first annular sealing surface of said first seal ring, said second seal ring further including a radially outermost surface and an axially-facing surface on the opposite side of said second seal ring from said second annular sealing surface;

a cushioning ring having a generally L-shaped cross-section and including a base portion engaging at least a portion of said axially-facing surface of said second seal ring, and having a flange portion extending from said base portion and engaging at least a portion of said radially outermost surface of said second seal ring;

a cone cutter having a central cavity receiving said journal shaft and having a seal gland housing said cushioning ring, said first and second seal rings, and said energizing ring; and wherein said energizing ring, said first and second seal rings and said cushioning ring are coaxially aligned with the axis of said journal shaft, and wherein said axially-facing surface of said second seal ring includes a radially-innermost portion that is free of engagement with said cushioning ring.

2. The drill bit of claim 1 wherein said flange portion of said cushioning ring includes an inner cylindrical surface defining an inside diameter $D_3$ of said cushioning ring when in an uncompressed condition; and wherein said second seal ring has an outside diameter $D_1$ that is greater than $D_3$.

3. The drill bit of claim 2 wherein said cushioning ring comprises at least one metal chosen from the group consisting of tin, copper, aluminum, magnesium, lead and alloys thereof.

4. The drill bit of claim 1 wherein said flange portion of said cushioning ring engages a portion of said radially outermost surface of said second seal ring.

5. The drill bit of claim 1 wherein, in cross-section, said flange portion of said cushioning ring has a thickness $T_2$, said base portion of said cushioning ring has a thickness $T_1$, and wherein $T_2$ is greater than $T_1$.

6. The drill bit of claim 1 wherein said second seal ring further comprises an annular bevel between said radially outermost surface and said axially-facing surface.

7. The drill bit of claim 6 further comprising an annular void between said cushioning ring and said second seal ring adjacent to said annular bevel.

8. The drill bit of claim 1 wherein said seal gland in said cone includes an outer cylindrical surface intersecting an axial surface at a corner, and wherein said drill bit further comprises an annular void between said cone cutter and said cushioning ring adjacent to said corner of said gland.

9. A drill bit for drilling through earthen formations comprising:

a bit body;

a journal shaft extending from said bit body;

an energizing ring disposed about said journal shaft;

a first seal ring disposed about said journal shaft and contacting said energizing ring, said first seal ring having a first annular sealing surface;

a second seal ring disposed about said journal shaft and having a second annular sealing surface engaging said first annular sealing surface of said first seal ring, said second seal ring further including a radially outermost surface and an axially-facing surface on the opposite side of said second seal ring from said second annular sealing surface;

a cushioning ring having a generally L-shaped cross-section and including a base portion engaging at least a portion of said axially-facing surface of said second seal ring, and having a flange portion extending from said base portion and engaging at least a portion of said radially outermost surface of said second seal ring;

a cone cutter having a central cavity receiving said journal shaft and having a seal gland housing said cushioning ring, said first and second seal rings, and said energizing ring; and wherein said seal gland in said cone includes an outer cylindrical surface intersecting an axial surface at a corner, and wherein said drill bit further comprises an annular void between said cone cutter and said cushioning ring adjacent to said corner of said gland.

10. A drill bit for drilling through earthen formations, comprising:

a bit body;

a journal pin extending from said bit body;

a rolling cone cutter rotatably mounted on said journal pin and having a journal surface;

a seal gland between said cone cutter and said journal pin;

a seal assembly disposed in said seal gland, said seal assembly comprising;

a first seal ring comprising a first material and having a radially-outermost surface, a first sealing surface, and a facing surface opposite of said sealing surface;

a cushioning ring comprising a second material having a hardness that is less than the hardness of said first material, said cushioning ring having a base portion contacting said facing surface of said first seal ring and a flange portion contacting said radially-outermost surface of said first seal ring;

a second seal ring having a second sealing surface engaging said sealing surface of said first seal ring;

an energizing ring biasing said second seal ring into engagement with said first seal ring; and an annular void between said first seal ring and said cushioning ring at a location adjacent to the intersection of said base and flange portions of said cushioning ring.

11. The drill bit of claim 10 wherein said energizing ring contacts said bit body and said cushioning ring contacts said rolling cone cutter.

12. The drill bit of claim 10 wherein said cushioning ring comprises an elastomeric material having a durometer hardness less than the durometer hardness of said energizing ring.

13. The drill bit of claim 10 wherein said first seal ring includes a beveled annular surface between said radially-outermost surface and said facing surface.

14. The drill bit of claim 10 wherein said flange portion of said cushioning ring includes an inner surface that, prior to assembly and in an uncompressed state, defines an inner diameter $D_3$;

wherein said first seal ring has an outer diameter $D_1$ as defined by said radially-outermost surface; and wherein $D_1$ is greater than $D_3$.

15. The drill bit of claim 14 wherein said facing surface of said first seal ring includes an innermost-annular portion that is free of contact with said cushioning ring, whereby a gap remains between said base portion of said cushioning ring and said journal shaft.

16. The drill bit of claim 10 wherein, in cross-section, said flange portion of said cushioning ring has a thickness $T_2$ and said base portion has a thickness $T_1$ and wherein $T_2$ is greater than $T_1$.

17. The drill bit of claim 10 wherein said flange portion and said base portion of said cushioning ring intersect and define an outer annular shoulder, said drill bit further comprising an annular void between said cushioning ring and said rolling cone cutter adjacent to said outer shoulder.

18. The drill bit of claim 10 wherein said flange contacts a portion of said radially-outermost surface of said first seal ring.

19. The drill bit of claim 10 wherein said second seal ring includes a radially-outermost surface generally concentric with said journal surface, and an annular recess between said radially-outermost surface and said second annular sealing surface.

20. The drill bit of claim 10 wherein said second material is elastomeric.

21. The drill bit of claim 10 wherein said second material has a hardness less than 100 HB.

22. The drill bit of claim 10 wherein said energizing ring contacts said rolling cone cutter and said cushioning ring contacts said bit body.

23. A drill bit for drilling through earthen formations, comprising:

a bit body;

a journal pin extending from said bit body;

a rolling cone cutter rotatably mounted on said journal pin and having a journal surface;

a seal gland between said cone cutter and said journal pin;

a seal assembly disposed in said seal gland, said seal assembly comprising;

a seal ring comprising a first material and having a radially-outermost surface, a first sealing surface, and a facing surface opposite of said sealing surface;

a cushioning ring comprising a second material having a hardness that is less than the hardness of said first material, said cushioning ring having a base portion contacting said facing surface of said first seal ring and a flange portion contacting said radially-outermost surface of said first seal, ring;

a second seal ring having a second sealing surface engaging said sealing surface of said first seal ring;

an energizing ring biasing said second seal ring into engagement with said first seal ring; and wherein said energizing ring contacts said rolling cone cutter and said cushioning ring contacts said bit body.

24. A drill bit for drilling through earthen formations, comprising;

a bit body;

a journal pin extending from said bit body;

a rolling cone cutter rotatably mounted on said journal pin and having a journal surface;

a seal gland between said cone cutter and said journal pin;

a seal assembly disposed in said seal gland, said seal assembly comprising:

a first ring comprising, a radially-outermost surface, a dynamic sealing surface, and a static surface opposite from said dynamic sealing surface;

a second ring comprising a base portion and an annular flange portion extending from said base portion, said flange portion extending axially along said radially-outermost surface of said first ring and said base portion extending radially along said static surface of said first ring;

wherein said second ring comprises a second material and said first ring comprises a first material, said second material being softer than said first material; and wherein said first ring has a central aperture having diameter $D_4$, said base portion of said second ring includes a central aperture having diameter $D_2$, said first and second rings are coaxially aligned, and wherein $D_2$ is greater than $D_4$.

25. The drill bit of claim 24 wherein said flange portion of said second ring includes an inner surface having diameter $D_3$ in an uncompressed state prior to receiving said first ring; and wherein said first ring includes an outer diameter $D_1$ defined by said radially-outermost surface, and wherein $D_1$ is greater than $D_3$.

26. The seal assembly of claim 24 wherein said flange portion covers a portion of said radially-outermost surface of said first ring.

27. The seal assembly of claim 26 wherein said flange portion has a cross-sectional thickness that is greater than the cross-sectional thickness of said base portion.

28. The seal assembly of claim 24 further comprising:

an annular shoulder at the intersection of said radially-outermost surface and said static surface of said first seal ring; and an annular void between said first ring and said second ring adjacent to said shoulder.

29. The seal assembly of claim 28 wherein said first seal ring further comprises an annular bevel extending between said radially-outermost surface and said static surface.

30. The seal assembly of claim 24 further comprising:

a third ring having a sealing surface, wherein said base portion of said second ring comprises an energizer biasing said sealing surface of said first ring toward said sealing surface of said third ring.

31. The seal assembly of claim 30 further comprising: an energizing ring biasing said sealing surface of said third ring towards said sealing surface of said first ring, and wherein said energizing ring is made of material having a durometer hardness that ranges between 55 A and 95 A and said base portion of said second ring is made of a material having a durometer hardness that ranges between 60 A and 110 A.

32. The seal assembly of claim 30 further comprising: an energizing ring biasing said sealing surface of said third ring towards said sealing surface of said first ring, and wherein said energizing ring is made of material having a durometer hardness that is less than the durometer hardness of said base portion of said second ring.

33. The seal assembly of claim 25 further comprising:

a third ring having a sealing surface, wherein said base portion of said second ring comprises an energizer biasing said sealing surface of said first ring toward said sealing surface of said third ring.

34. The seal assembly of claim 33 further comprising:

an energizing ring biasing said sealing surface of said third ring towards said sealing surface of said first ring, and wherein said energizing ring is made of material having a durometer hardness that ranges between 55 A and 95 A and said base portion of said second ring is made of a material having a durometer hardness that ranges between 60 A and 110 A.

35. The seal assembly of claim 33 further comprising:

an energizing ring biasing said sealing surface of said third ring towards said sealing surface of said first ring, and wherein said energizing ring is made of material having a durometer hardness that is less than the durometer hardness of said base portion of said second ring.

36. The seal assembly of claim 24 wherein said second ring is formed of a material having a durometer hardness less than 110 A, and wherein said first seal ring is formed of a material having a Rockwell hardness greater than 50 HRc.

37. The seal assembly of claim 36 wherein said second seal ring comprises an elastomeric material.

38. The seal assembly of claim 36 wherein said second seal ring comprises at least one material chosen from the group consisting of tin, copper, aluminum, magnesium, lead and alloys thereof.

39. The seal assembly of claim 36 wherein said second seal ring comprises at least one material chosen from the group consisting of nylon-zytel, acetal, and polypropylene.

40. The seal assembly of claim 38 wherein said flange portion of said second ring engages a portion of said radially-outermost surface of said first ring.

41. The seal assembly of claim 24 wherein said base portion of said second ring seals against said static surface of said first ring, and wherein said flange portion of said second ring seals against said radially-outermost surface of said first ring, and wherein said radially-outermost surface and said static surface of said first ring intersect at an annular shoulder, and wherein said seal assembly further comprises an annular void adjacent to said annular shoulder between said first ring and said second ring.

42. The seal assembly of claim 41 wherein said sealing surface and said static surface of sad first ring are substantially parallel, and wherein said annular shoulder of said first ring comprises a beveled surface extending between said radially-outermost surface and said static surface.

43. A drill bit for drilling through earthen formations, comprising:

a bit body;

a journal pin extending from said bit body;

a rolling cone cutter rotatably mounted on said journal pin and having a journal surface;

a seal gland between said cone cutter and said journal pin;

a seal assembly disposed in said seal gland, said seal assembly comprising:

a first ring comprising a radially-outermost surface, a dynamic sealing surface, and a static surface opposite from said dynamic sealing surface;

a second ring comprising a base portion and an annular flange portion extending from said base portion, said flange portion extending axially along said radially-outermost surface of said first ring and said base portion extending radially along said static surface of said first ring;

wherein said second ring comprises a second material and said first ring comprises a first material, said second material being softer than said first material; and wherein said base portion of said second ring seals against said static surface of said first ring, and wherein said flange portion of said second ring seals against said radially-outermost surface of said first ring, and wherein said radially-outermost surface and said static surface of said first ring intersect at an annular shoulder, and wherein said seal assembly further comprises an annular void adjacent to said annular shoulder between said first ring and said second ring.

44. The seal assembly of claim 43 wherein said sealing surface and said static surface of said first ring are substantially parallel, and wherein said annular shoulder of said first ring comprises a beveled surface extending between said radially-outermost surface and said static surface.

* * * * *